US006929468B2

(12) United States Patent
Wang

(10) Patent No.: US 6,929,468 B2
(45) Date of Patent: Aug. 16, 2005

(54) BLOWTORCH

(75) Inventor: Terry Wang, Taichung Hsien (TW)

(73) Assignee: Arlo Lin, Tortola (VG)

( * ) Notice: Subject to any disclaimer, the term of this patent is extended or adjusted under 35 U.S.C. 154(b) by 0 days.

(21) Appl. No.: 10/714,992

(22) Filed: Nov. 17, 2003

(65) Prior Publication Data

US 2005/0106521 A1 May 19, 2005

(51) Int. Cl.[7] ..... F23D 14/38
(52) U.S. Cl. ..... 431/344; 431/153; 251/205
(58) Field of Search ..... 431/344, 345, 431/153, 255, 258; 251/205, 284, 89

(56) References Cited

U.S. PATENT DOCUMENTS 3,694,134 A * 9/1972 Ross ..... 431/255
4,832,595 A * 5/1989 Eads ..... 431/344
5,123,837 A * 6/1992 Farnham et al. ..... 431/258
5,470,227 A * 11/1995 Mims et al. ..... 431/345
5,564,919 A * 10/1996 Tsai ..... 431/344

FOREIGN PATENT DOCUMENTS

DE 1 621 866 B * 10/1970

* cited by examiner

*Primary Examiner*—Josiah C. Cocks
(74) *Attorney, Agent, or Firm*—Alan D. Kamrath; Nikolai & Mersereau, P.A.

(57) ABSTRACT

A valve is provided for a blowtorch. The valve includes a housing, a switching device and an adjusting device. The housing is connected between a reservoir and a nozzle of the blowtorch. The switching device is provided for switching the valve between a communicating mode and a blocking mode. The adjusting device is provided for adjusting the flow rate of the gas through the valve.

20 Claims, 10 Drawing Sheets

BLOWTORCH

FIELD OF INVENTION

The present invention relates to a blowtorch.

BACKGROUND OF INVENTION

Referring to FIG. 10, a conventional blowtorch 90 includes a reservoir 96 and a valve. The valve includes a housing 91 and a plunger 94. The housing 91 includes a chamber 97, an inlet 92 and an outlet 93. The chamber 97 includes a conical portion through which the inlet 92 is communicated with the outlet 93. The plunger 94 is installed in the chamber 97 in a movable manner. The plunger 94 includes a conical portion for insertion into the conical portion of the chamber 97. The flow rate of gas is determined by the position of the conical portion of the plunger 94 relative to the conical portion of the chamber 97. It is intended that the communication between the inlet 92 and the outlet 93 be interrupted by the conical portion of the plunger 94 when the conical portion of plunger 94 is completely inserted in the conical portion of the chamber 97. To this end, the conical portion of the plunger 94 must be shaped in perfect compliance with the conical portion of the chamber 97. This is, however, difficult in reality. In case the conical portion of the plunger 94 is not shaped in perfect compliance with the conical portion of the chamber 97, the flow of the gas cannot be completely shut off, and this is dangerous.

The present invention is therefore intended to obviate or at least alleviate the problems encountered in the prior art.

SUMMARY OF INVENTION

It is the primary objective of the present invention to provide a blowtorch with a secure valve.

According to the present invention, a valve is provided for a blowtorch. The valve includes a housing, a switching device and an adjusting device. The housing is connected between a reservoir and a nozzle of the blowtorch. The switching device is provided for switching the valve between a communicating mode and a blocking mode. The adjusting device is provided for adjusting the flow rate of the gas through the valve.

Other objectives, advantages and novel features of the invention will become more apparent from the following detailed description in conjunction with the attached drawings.

BRIEF DESCRIPTION OF DRAWINGS

The present invention will be described via detailed illustration of embodiments referring to the drawings.

DETAILED DESCRIPTION OF EMBODIMENTS

Figure 1:
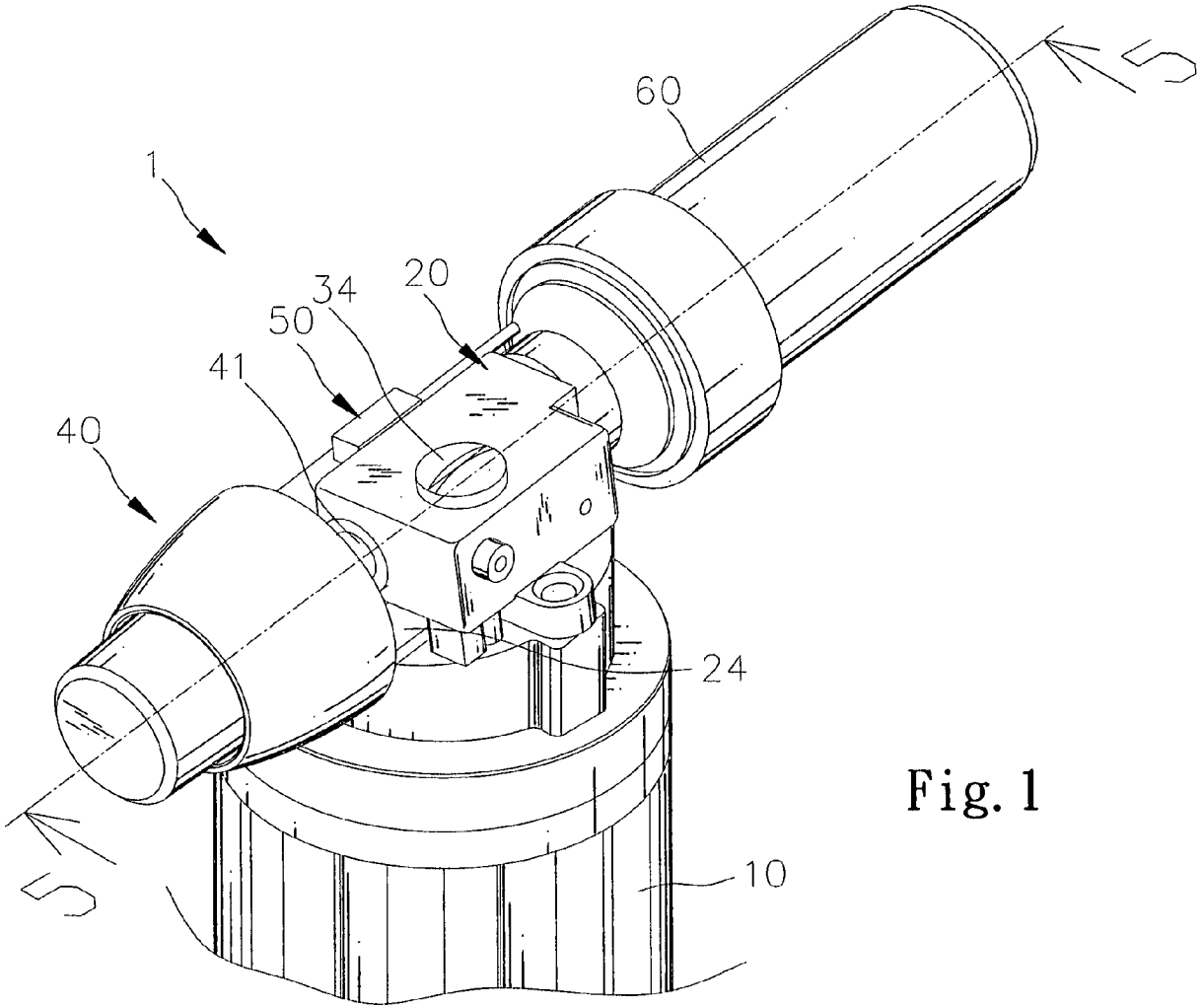
FIG. 1 is a perspective view of a portion of a blowtorch according to the preferred embodiment of the present invention.
Figure 2:
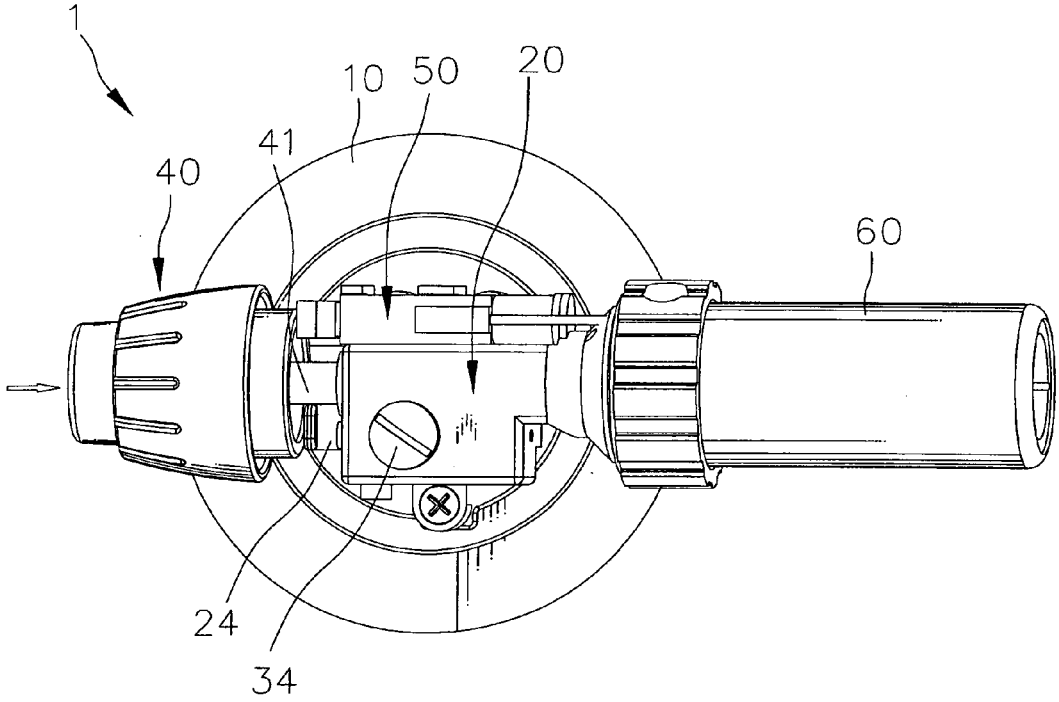
FIG. 2 is a top view of the blowtorch of FIG. 1.

Referring to FIGS. 1 and 2, a blowtorch 1 is shown according to the preferred embodiment of the present invention. The blowtorch 1 includes a reservoir 10 for storing gas, a valve 20 for controlling the flow of the gas from the reservoir 10, a nozzle 60 for spraying the gas from the valve 20 and an igniter 50 for igniting the gas sprayed from the nozzle 60.

Figure 3:
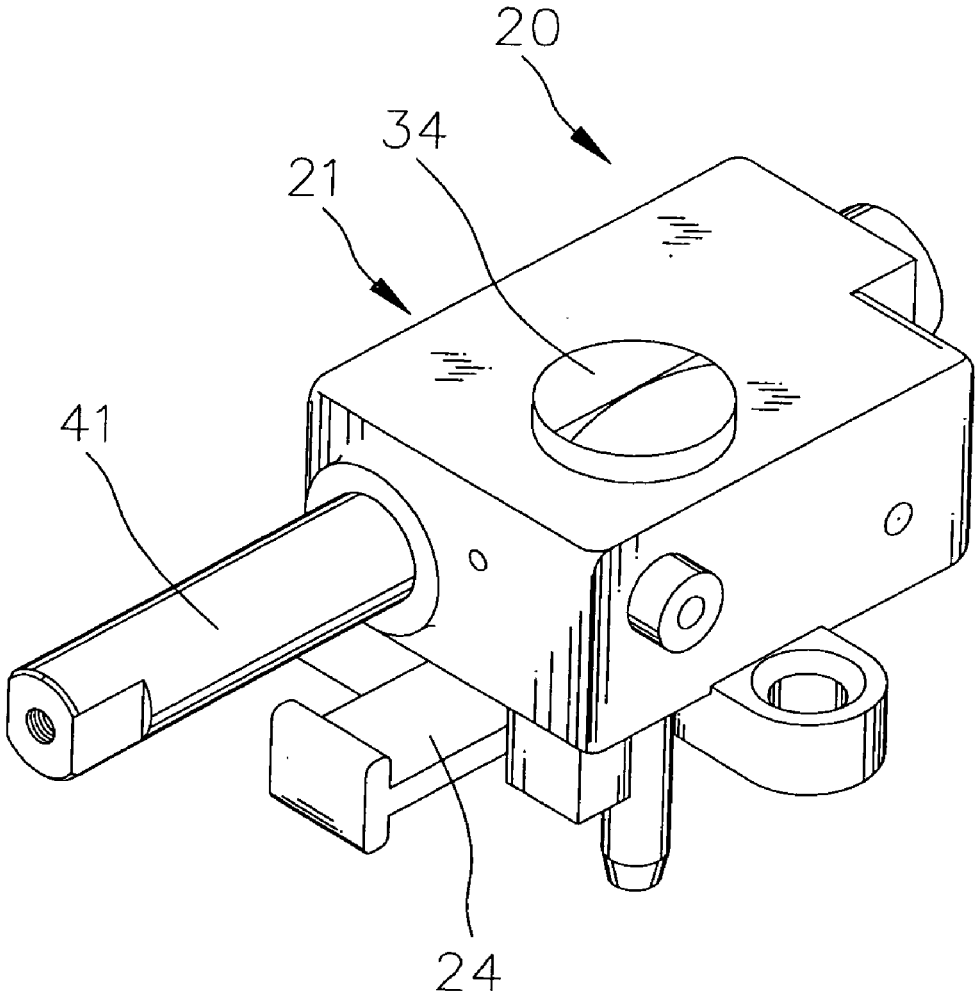
FIG. 3 is a perspective view of a valve of the blowtorch of FIG. 1.
Figure 4:
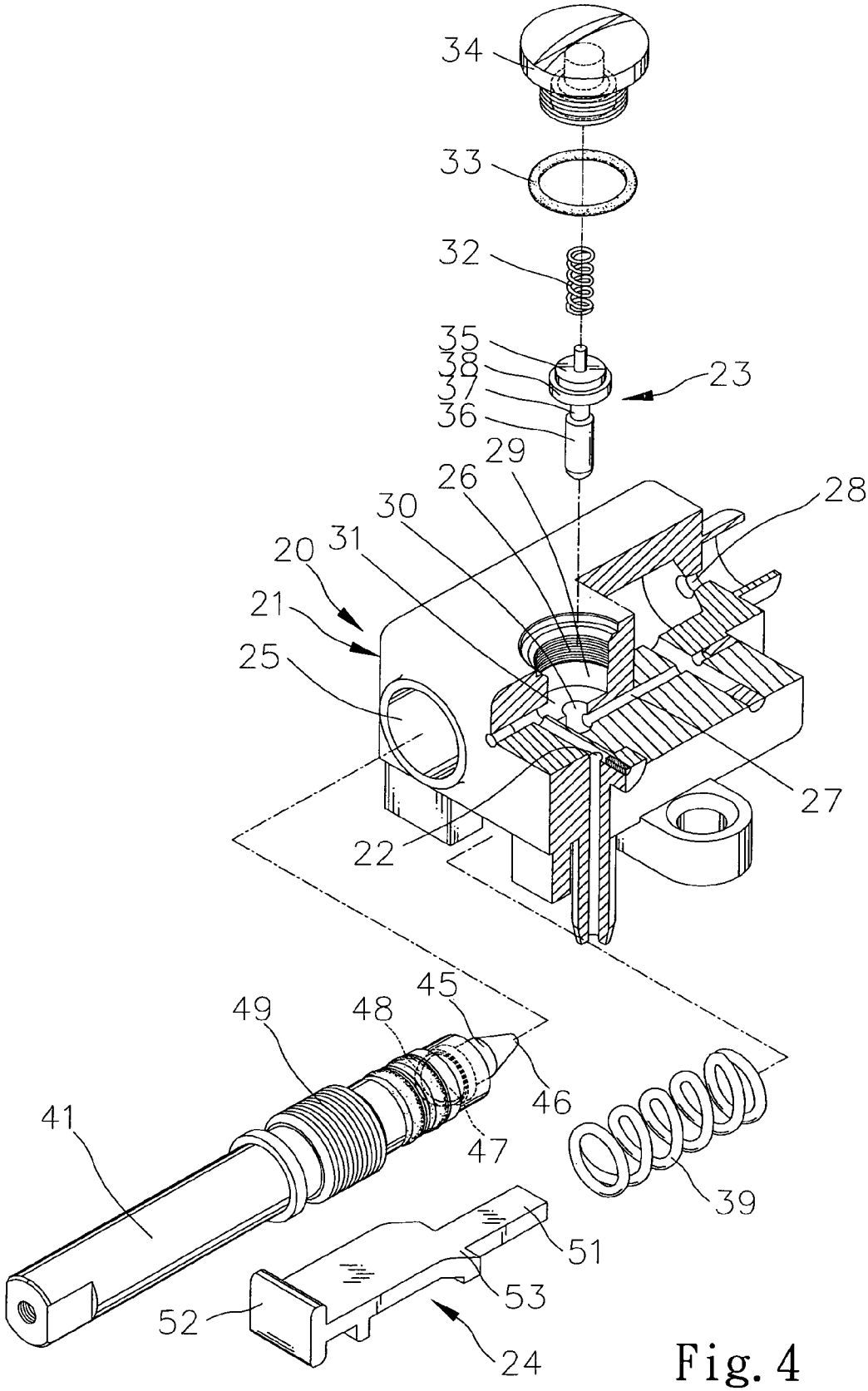
FIG. 4 is an exploded view of the valve of FIG. 3 and shows a housing of the valve in a cutaway manner.

Referring to FIGS. 3 and 4, the valve 20 includes a housing 21, a switching device for switching the valve 20 between a communicating mode and a blocking mode and an adjusting device for adjusting the flow rate of the gas through the valve 20.

Figure 7:
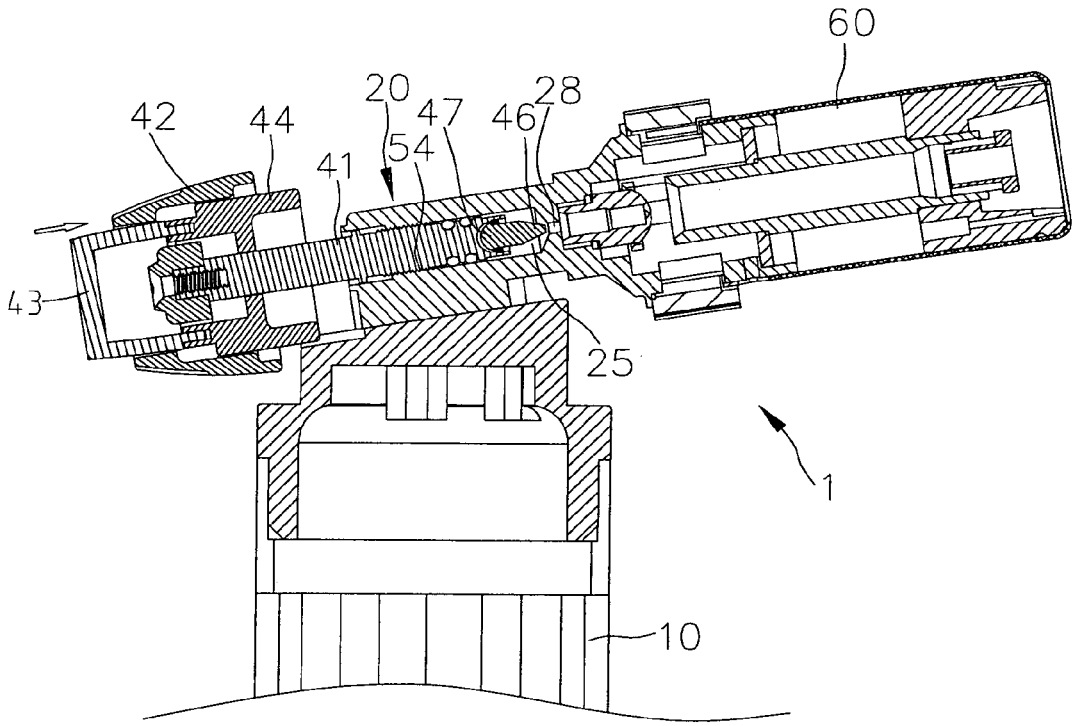
FIG. 7 is another cross-sectional view of the blowtorch of FIG. 6.
Figure 8:
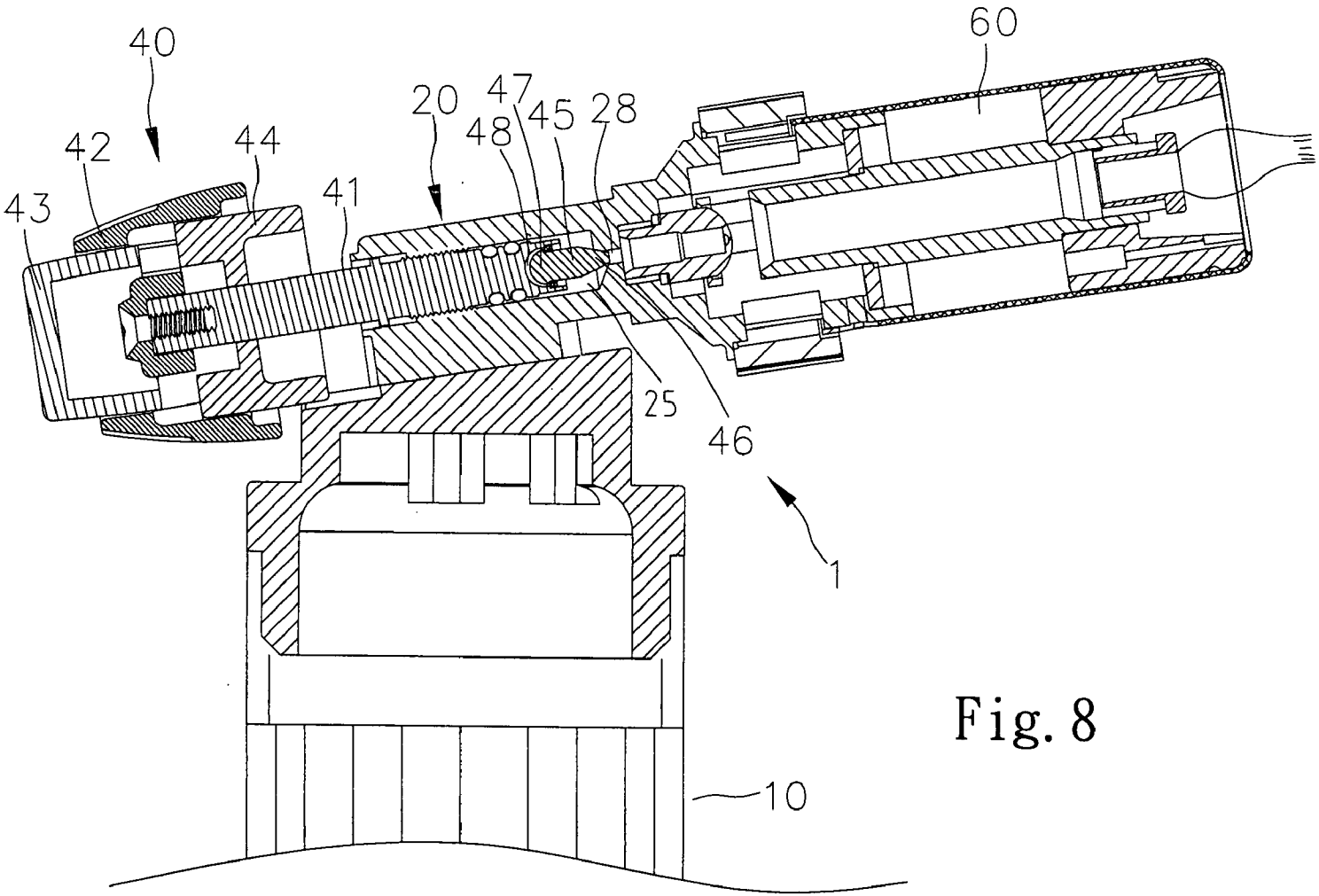
FIG. 8 is similar to FIG. 7 but shows the blowtorch in another position.
Figure 9:
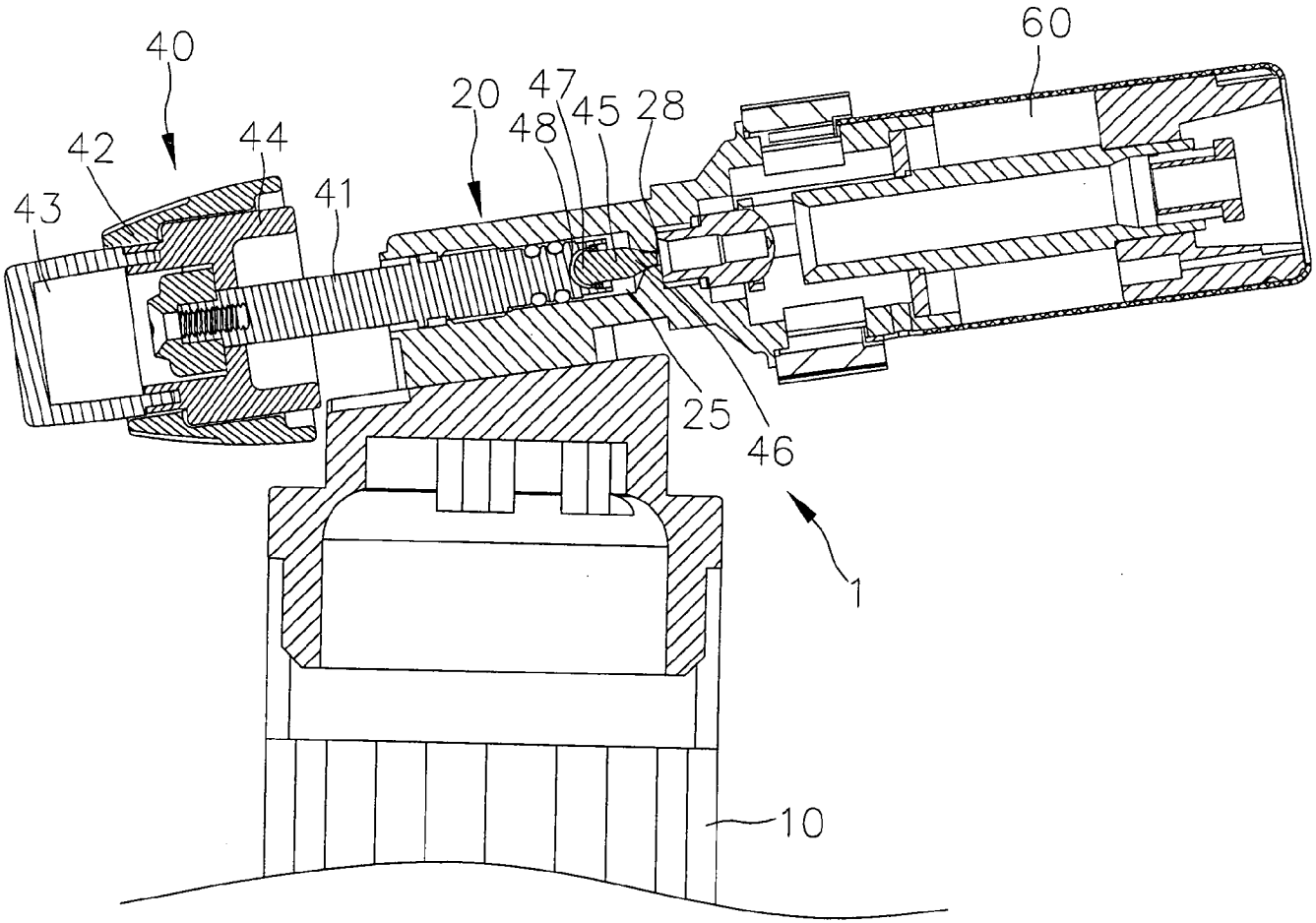
FIG. 9 is another cross-sectional view of the blowtorch of FIG. 8.
Figure 10:
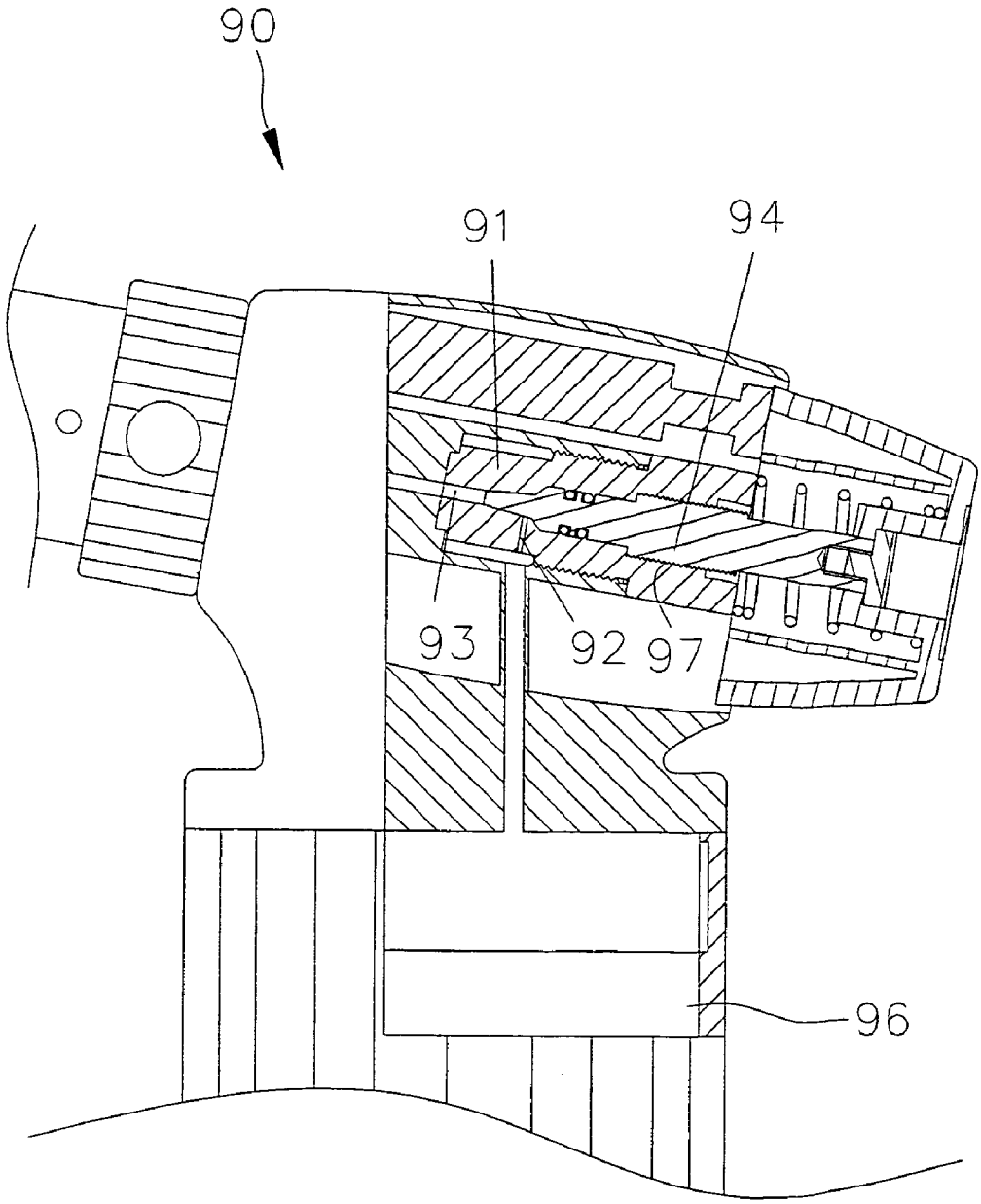
Fig. 10 PRIOR ART
FIG. 10 is a cross-sectional view of a conventional blowtorch.

The housing 21 includes an inlet 22 communicated with the reservoir 10, a first chamber 26 communicated with the inlet 22, a channel 27 communicated with the first chamber 26, a second chamber 25 communicated with the channel 27 and an outlet 28 communicated with the second chamber 25. The first chamber 26 includes a wide portion 29 and a narrow portion 30, thus forming an annular shoulder 31 between the wide portion 29 and the narrow portion 30. The inlet 22 leads to the wide portion 29 of the first chamber 26. From the narrow portion 30 of the first chamber 26 leads the channel 27. A thread (not numbered) is formed on the wall of the large portion 29 of the first chamber 26. As shown in FIGS. 7–9, a thread 54 is formed on the wall of the second chamber 25.

The switching device includes a plunger 23, a spring 32, an annular seal 33, a cap 34, a pusher 24 and a spring 39. The plunger 23 includes a wide portion 35 and a narrow portion 36 extending from the wide portion 35. The narrow portion 36 of the plunger 23 includes a first annular groove (not numbered) and a second annular groove 37. An annular seal 38 is put around the narrow portion 36 of the plunger 23, with an internal edge thereof put in the first annular groove.

Figure 5:
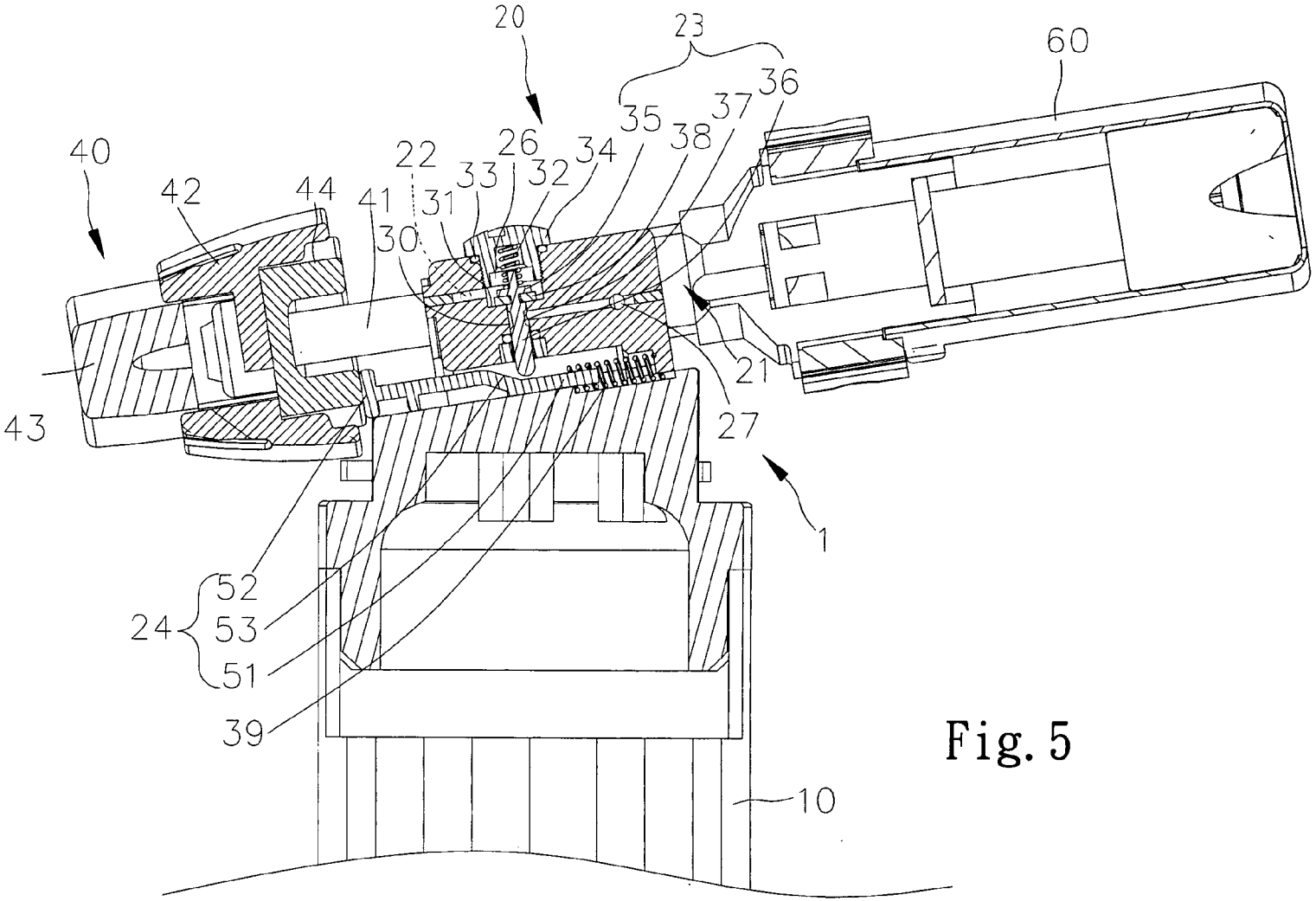
FIG. 5 is a cross-sectional view of the blowtorch taken along a line 5—5 in FIG. 1.

Referring to FIG. 5, the narrow portion 36 of the plunger 23 is inserted through the narrow portion 30 of the first chamber 26 while the wide portion 35 of the plunger 23 is put into the wide portion 29 of the first chamber 26. The spring 32 is put in the wide portion 29 of the first chamber 26. The annular seal 33 is put on the housing 21. The cap 34 is secured to the housing 21, thus retaining the plunger 23, the spring 32 and the annular seal 33. To this end, the cap 34 includes a thread (not numbered) engaged with the thread formed on the wall of the wide portion 29 of the first chamber 26.

A pusher 24 is provided in order to push the narrow portion 36 of the plunger 23. The pusher 24 is put next to the housing 21 and movable relative to the narrow portion 36 of the plunger 23 between the position shown in FIG. 5 and a position shown in FIG. 6. The pusher 24 includes a first end 51, a second end 52 and an inclined portion 53 formed between the first end 51 and the second end 52. The first end 51 of the pusher 24 is reduced in size. The second end 52 of the pusher 24 is formed as a plate.

The spring 39 is compressed between the inclined portion 53 of the pusher 24 and a portion of the housing 21. The first end 51 of the pusher 24 is inserted in the spring 39.

In the position shown in FIG. 5, the inclined pusher 24 does not contact the narrow portion of the plunger 23. The annular seal 38 is forced against the annular shoulder 31 by the spring 32 so as to block the communication between the wide portion 29 and the narrow portion 30 of the first chamber 26. The valve 20 is in the blocking mode.

Figure 6:
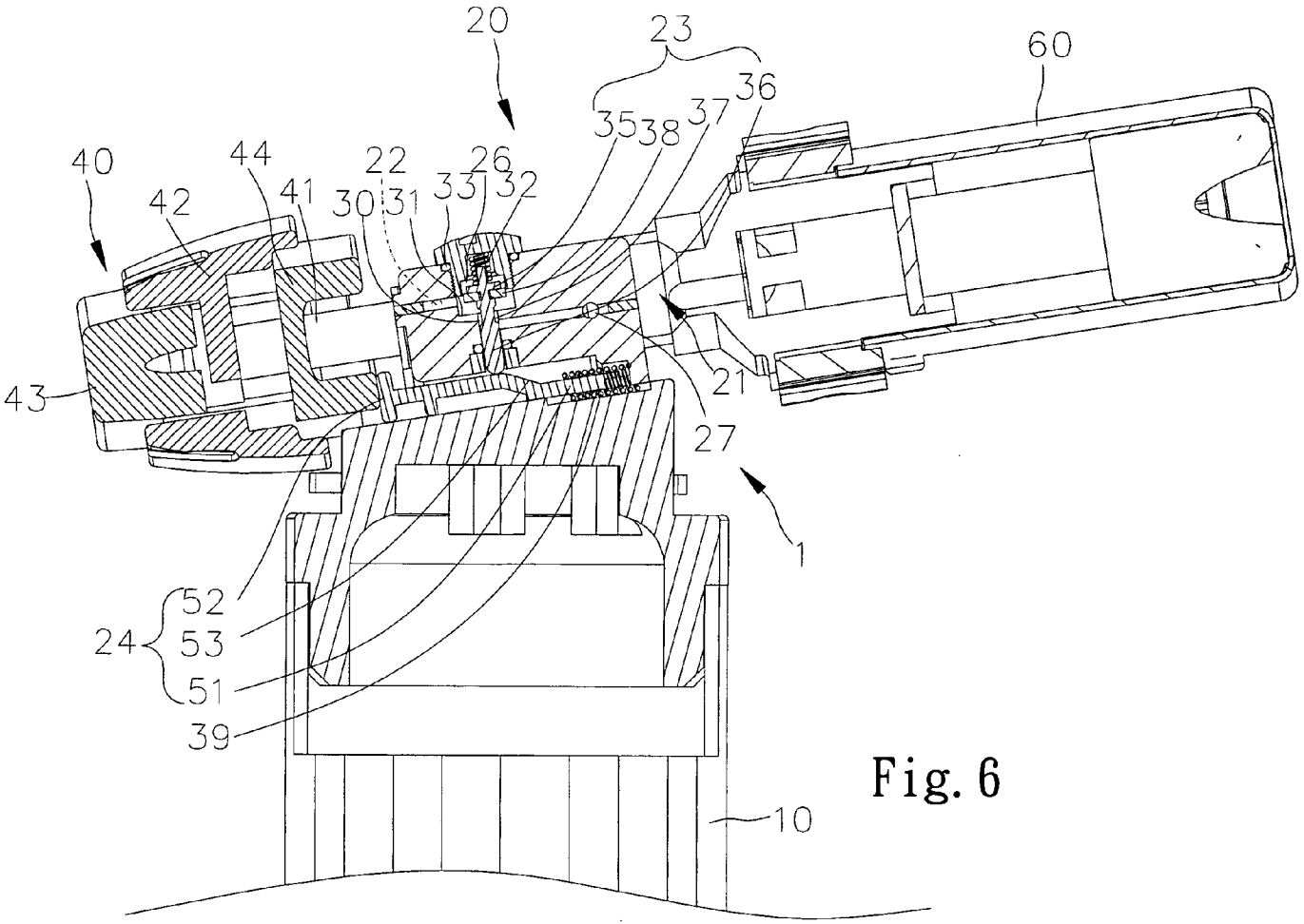
FIG. 6 is similar to FIG. 5 but shows the blowtorch in another position.

In the position shown in FIG. 6, the pusher 24 is moved to the right so that the inclined portion 53 of the pusher 24 pushes the narrow portion 36 of the plunger 23. The annular seal 38 is moved from the annular shoulder 31 so as to allow the communication between the wide portion 29 and the narrow portion 30 of the first chamber 26. The valve 20 is in the communicating mode.

Referring to FIG. 4, the adjusting device includes a plunger 45 and a driver 41. The plunger 45 includes a conical end 46 and a round end 47. The driver 41 includes a recessed end 48 and a thread 49 formed thereon. The round end 47 of the plunger 45 is put in the recessed end 48 of the driver 41 like a ball-and-socket device. Hence, disengagement of the, round end 47 of the plunger 45 from the recessed end 48 of the driver 41 is prevented while rotation of the round end 47 of the plunger 45 in the recessed end 48 of the driver 41 is allowed.

Referring to FIG. 7, the plunger 45 and the driver 41 are driven into the second chamber 25 by rotating the driver 41 relative to the housing 21 as the thread 49 is engaged with the thread 54. The conical end 46 of the plunger 45 is aligned with the outlet 28.

Referring to FIG. 8, via rotating the driver 41 relative to the housing 21, the conical end 46 of the plunger 45 is moved into the outlet 28. The outlet 28 is partially shut. Thus, the flow rate of the gas through the valve 20 is tuned down.

Referring to FIG. 9, via rotating the driver 41 relative to the housing 21, the conical end 46 of the plunger 45 is further moved into the outlet 28. Thus, the flow rate of the gas through the valve 20 is further tuned down.

The plunger 45 and the driver 41 are made separately and connected with each other so that relative rotation of each other is allowed. Thus, in case the second chamber 25 is not aligned perfectly with the outlet 28, or in the case the conical end 46 of the plunger 45 is not made perfectly compliant with the outlet 28, the plunger 45 automatically rotates relative to the driver 41 to ensure the conical end 46 thereof adequately seals the outlet 28.

A handle device 40 is provided for driving the pushers 24 and 41. The handle device 40 includes an external button 43 and an internal button 44 for driving the pusher 24. The handle device 40 includes a knob 42 for driving the driver 41. The handle device 40 will not be described in detail for not being the spirit of the present invention.

The present invention has been described via detailed illustration of some embodiments. Those skilled in the art can derive variations from the embodiments without departing from the scope of the present invention. Therefore, the embodiments shall not limit the scope of the present invention defined in the claims.

What is claimed is:

1. A valve for a blowtorch, the valve comprising a housing connected between a reservoir and a nozzle of the blowtorch, a switching device for switching the valve between a communicating mode and a blocking mode and an adjusting device for adjusting the flow rate of the gas through the valve, wherein the housing includes a first chamber, wherein the switching device includes a switch plunger installed and reciprocal in the first chamber in a reciprocation direction between the communication mode and the blocking mode, wherein the switching device further includes a pusher contacting and pushing the switch plunger, wherein the pusher at a point of contact is movable relative the switch plunger in a movement direction nonparallel to the reciprocation direction.

2. The valve according to claim 1 wherein the pusher includes an inclined portion inclined from the movement direction and in the reciprocation direction, with the inclined portion contacting and pushing the plunger.

3. The valve according to claim 1 wherein the housing further includes a second chamber, wherein the adjusting device includes an adjusting plunger installed and reciprocal in the second chamber in an adjustment direction, with the adjustment direction being parallel to the movement direction.

4. The valve according to the claim 3 wherein the adjusting plunger is rotatable along the adjustment direction, with the adjustment plunger including a knob for rotating the adjustment plunger, with the valve further including an internal button slideable relative to the knob and engaging with the pusher for moving the pusher in the movement direction.

5. The valve according to claim 4 further including an external button, with the external and internal buttons located on opposite axial sides of the knob, with the internal button located intermediate the external button and the pusher.

6. The valve according to claim 3 wherein the housing includes an inlet communicated with the reservoir of the blowtorch and an outlet communicated with the nozzle of the blowtorch, with the first chamber communicated with the inlet, wherein the housing further includes a channel communicated with the first chamber, wherein the channel is communicated with the outlet through the second chamber.

7. The valve according to claim 6 wherein the first chamber includes a wide portion, a narrow portion and an annular shoulder formed between the wide portion and the narrow portion, and the switch plunger of the switching device leaves the annular shoulder in the communicating mode but abuts the annular shoulder in the blocking mode.

8. The valve according to claim 7 wherein the inlet leads to the large portion of the first chamber, and the channel leads from the narrow portion of the first chamber.

9. The valve according to claim 7 wherein the switch plunger includes a wide portion installed in the wide portion of the first chamber for abutment against the annular shoulder of the first chamber and a narrow portion installed substantially in the narrow portion of the first chamber.

10. The valve according to claim 9 wherein the narrow portion of the switch plunger extends through the narrow portion of the first chamber, with the pusher contacting and pushing the narrow portion of the switch plunger.

11. The valve according to claim 9 wherein the switching device further includes an annular seal put around the narrow portion of the switch plunger for abutment against the annular shoulder.

12. The valve according to claim 10 wherein the annular seal includes an internal edge put in an annular groove defined in the narrow portion of the switch plunger of the switching device.

13. The valve according to claim wherein 9 the switching device further includes a cap threadably engaged in the first chamber and for keeping the switch plunger in the first chamber.

14. The valve according to claim 13 wherein the cap includes a wide portion put against the housing and a narrow portion put in the first chamber.

15. The valve according to claim 13 wherein the switching device further includes an annular seal put between the wide portion of the cap and the housing.

16. The valve according to claim 13 wherein the switching device further includes a spring compressed between the cap and the switch plunger.

17. The valve according to claim 6 wherein the adjusting plunger of the adjusting device includes a conical end for sealing the outlet.

18. The valve according to claim 17 wherein the adjusting device further includes a driver installed in the second chamber for pushing the adjusting plunger.

19. The valve according to claim 18 wherein the driver of the adjusting device includes a thread formed thereon, and the second chamber includes a thread formed on a wall for engagement with the thread of the driver of the adjusting device.

20. The valve according to claim 18 wherein the adjusting plunger of the adjusting device includes a round end, and the driver of the adjusting device includes a recessed end for receiving the round end of the adjusting plunger.

* * * * *